United States Patent [19]

Zimmern

[11] 3,945,778

[45] Mar. 23, 1976

[54] COMPRESSORS AND EXPANSION MACHINES OF THE SINGLE WORM TYPE

[76] Inventor: Bernard Zimmern, 27 rue Delabordere, Neuilly-sur-Seine (Hauts-de-Seine), France, 92200

[22] Filed: Oct. 22, 1974

[21] Appl. No.: 516,984

[52] U.S. Cl. ..... 418/195; 74/425; 74/458

[51] Int. Cl.[2] F04C 17/10; F16H 1/16; F16H 55/08; F16H 55/22

[58] Field of Search ..... 418/194, 195; 74/458, 425

[56] References Cited

UNITED STATES PATENTS

| | | | |
|---|---|---|---|
| 678,570 | 7/1901 | Jones | 418/195 |
| 1,338,377 | 4/1920 | Kopf | 74/425 |
| 3,181,296 | 5/1965 | Zimmern | 418/195 X |

*Primary Examiner*—C. J. Husar
*Assistant Examiner*—Leonard Smith
*Attorney, Agent, or Firm*—Lane, Aitken, Dunner & Ziems

[57] ABSTRACT

A machine for compressing or expanding fluids in which a globoidal worm, having a plurality of threads with crests circumscribed by a surface generated by a rectilinear line and in meshing engagement with at least one toothed pinion, cooperates with a casing having at least one low pressure port and at least one high pressure port located in the immediate vicinity of the pinion. Each of the pinion teeth is provided with two substantially rectilinear flanks, the flank located on the side of the pinion nearest the low pressure port when one tooth is engaged in the worm being longer than the flank of the same tooth which is located nearest the high pressure port.

1 Claim, 4 Drawing Figures

COMPRESSORS AND EXPANSION MACHINES OF THE SINGLE WORM TYPE

As disclosed in particular in French Pat. Nos. 1,331,998, 1,586,832, 1,601,531, and 2,177,124, it is known to construct compressors or expansion machines of the type in which provision is made for a globoidal worm disposed in meshing engagement with at least one pinion.

In accordance with the technique described in particular in French Pat. No. 1,331,998, volumetric compression ratios of 5 to 6 can readily be obtained when making use of cylindrical worms having six threads and cooperating with pinions each provided with a number of teeth ot the order of 11.

The above-mentioned compression ratio is wholly suitable for producing compressed air at an effective pressure of 7 bars but is insufficient for the purpose of attaining higher pressures of the order of 12 to 16 bars.

In order to obtain volumetric compression ratios which correspond to these pressures and are of the order of 6 to 8, it is found necessary either to reduce the size of the exhaust ports, thus resulting in very high rates of gas flow through the high-pressure orifice, drops in pressure and unsatisfactory efficiency, or to increase the number of threads which are in mesh at the same time with any one pinion and to employ, for example, worms having eight threads. However, the increase in the number of threads in mesh with a given pinion is achieved at the expense of the available volume between the threads, with the result that there is a reduction in the swept volume and also a reduction in the width of the tooth at the precise moment of increase in the pressure which said tooth is intended to withstand.

The aim of this invention is to provide a compressor or rotary expansion machine comprising a globoidal worm which has a plurality of threads disposed in meshing engagement with at least one toothed pinion and which cooperates with a casing applied against at least part of the external surface of the worm, the generating line of the surface which is circumscribed about the threads crests of the worm being substantially rectilinear, at least one low-pressure port and at least one high-pressure port located in the immediate vicinity of the pinion, characterized in that each tooth of said pinion has two substantially rectilinear flanks, the flank located on the side nearest the low-pressure port when one tooth is engaged in the worm being longer than the flank of the same tooth which is located nearest the high-pressure port.

By virtue of this arrangement, it is in fact possible to retard the establishment of communication between the thread and the discharge port while maintaining substantial dimensions of this latter in order to prevent any loss of pressure.

A better understanding of the present invention will be gained from the following description which is given by way of non-limitative example and from the accompanying drawings in which.

Figure 1:
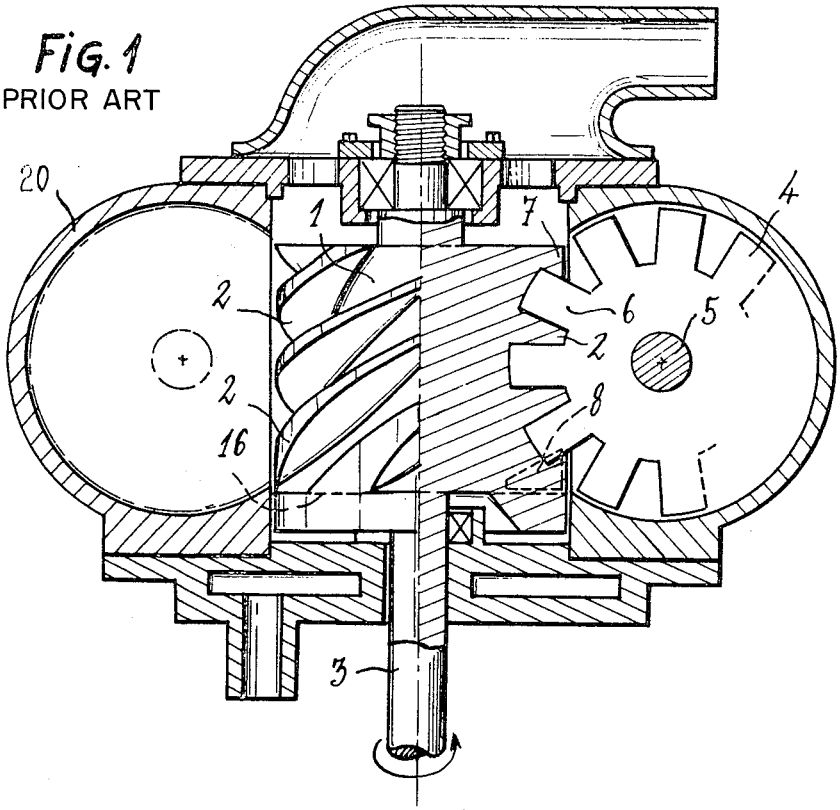
FIG. 1 PRIOR ART
FIG. 1 is a view in cross-section of a compressor of known type, especially as disclosed in French Pat. Nos. 1,331,998 and 1,601,531.
Figure 2:
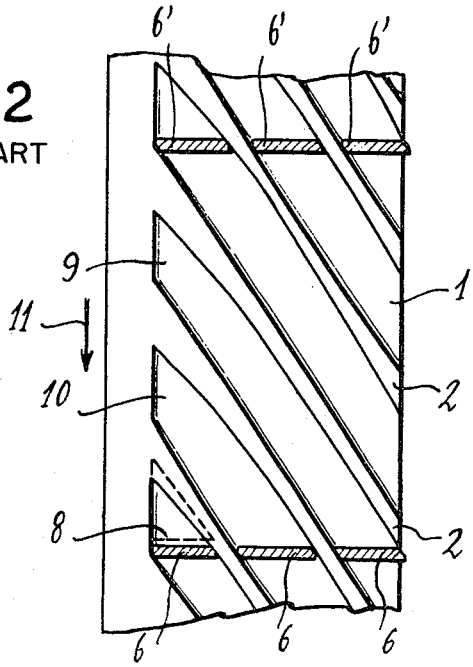
FIG. 2 PRIOR ART
FIG. 2 is a developed view showing the worm of FIG. 1 and the position of the exhaust port.

FIG. 1 shows a compressor or expansion unit of known type, rotating parts of which are constituted by a worm 1 provided with threads 2, said worm being capable of rotating about an axis 3 and disposed in meshing engagement with a pinion 4 which rotates about an axis 5 and is provided with teeth 6. A pinion which has been omitted and the teeth 6′ of which are shown in FIG. 2 is disposed symmetrically with the pinion 4 with respect to the worm 1. Said worm is surrounded by a casing 20 which permits the pinion to pass through and provides a communication between the zone 7 of the thread extremities and the low pressure, that is to say the suction in the case of a compressor and the discharge in the case of an expansion machine. A substantially triangular high-pressure port 8 is formed in said casing in the vicinity of the pinion 4; the compressed gases are discharged through said port in the case of a compressor or the gases to be expanded penetrate into said port in the case of an expansion machine; a symmetrical port (not shown in the drawings) is located in the vicinity of the other pinion.

FIG. 2 shows in a developed view of the worm of FIG. 1 the teeth 6 and 6′ of the pinion 4 and of the symmetrical pinion as well as the contours of the highpressure port 8 in dashed lines. By definition, the volumetric compression or expansion ratio is the ratio of volumes contained in the compression chambers formed by two successive threads, the casing and one pinion tooth when one chamber has just been closed by one tooth 6 and when said chamber begins to come into communication with the high-pressure port 8.

In the example of FIG. 2, it is apparent that the first volume is designated by the reference numeral 9 and the second volume is designated by the reference numeral 10 by reason of the fact that, if the machine operates as a compressor, for example, and the worm rotates in the direction of the arrow 11, a communication is about to be established between said second volume 10 and the port 8.

In accordance with this known technique, volumetric compression ratios within the range of 4 to 6 can readily be obtained in compressors or expansion units. In consequence, effective discharge pressures of 7 to 10 bars can be obtained in the case of compressed air by employing, for example, worms having six threads and two symmetrical pinions each having eleven teeth whilst the mean rates of flow of gas under pressure through the port 8 do not exceed 20 to 30 metres per second even when the peripheral velocity of the worm 1 attains 50 metres per second, which is the usual limit of utilisation. At a velocity of this order, the pressure drop through the port is negligible.

If it is desired to increase the compression ratio, it is necessary to reduce the volume 10 by retarding the establishment of communication with the port 8, thereby entailing the need to reduce the size of said port. But a reduction in cross-sectional area is faster than the increase in compression ratio and beyond a volumetric compression ratio of the order of 6, the reduction in cross-sectional area gives rise to gas flow velocities which increase very rapidly to infinity in respect of a negligible gain in compression ratio.

Another solution consists in increasing the number of threads of the worm and at the same time the number of threads which engage simultaneously with one pinion or, equivalently, the number of pinion teeth which engage simultaneously with the worm. However, each additional thread occupies a volume at the expense of the volume swept by the worm; moreover, this reduces the width of the teeth and reduces their longitudinal rigidity.

Figure 3:
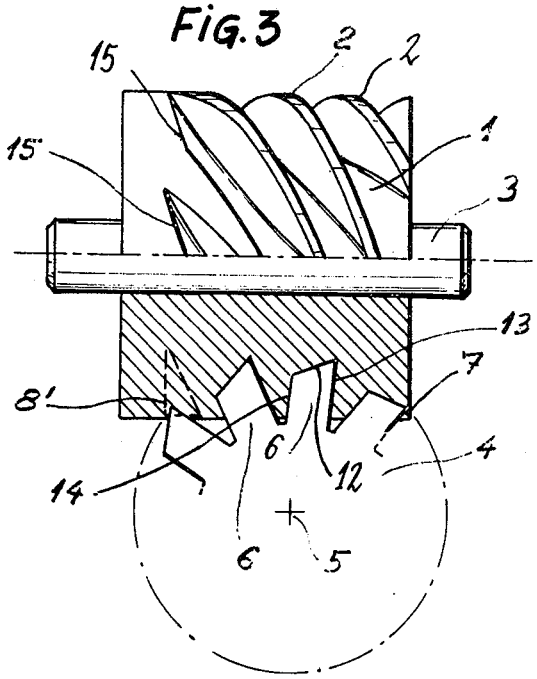
FIG. 3 shows the rotating parts of a compressor in accordance with the present invention.

The rotating parts of a compressor in accordance with the invention are shown in FIG. 3.

It will be noted in this arrangement that the tips of the teeth 6 are no longer disposed on a circle as in the case of FIG. 1 but each have a bevel 12 which joins the flank 13 to the flank 14; the flank 13 which is located on the low-pressure port side with respect to the tooth is longer than the flank 14 which is located on the high-pressure port side.

The bottoms of the worm threads are clearly machined so as to come into cooperating relation with the bevels 12. As a result of this inclination as well as the fact that the thread crests of the worm are disposed on a cylinder although the result would be the same if the crests were disposed on a cone or a plane or generally on a surface of revolution having a substantially rectilinear generating line and the fact that the depth of the threads is therefore variable, said threads accordingly terminate on the external profile of the worm along inclined lines 15 which are shown in FIGS. 3 and 4 and not on a great circle 16 of revolution with respect to the axis as shown in FIG. 1.

As a consequence of the foregoing, provision can be made for a port 8' which remains of large cross-sectional area but begins to open onto the thread 10 only when the line 15 — and not a thread flank of the compression chamber — comes into position opposite to said port.

The result thereby achieved is that, for example in the case of a compressor, the exhaust can be retarded up to the moment when the line 15 comes into coincidence with the line 17 and when the volume 10 has become the volume represented by the dotted zone 18 in the figure.

Figure 4:
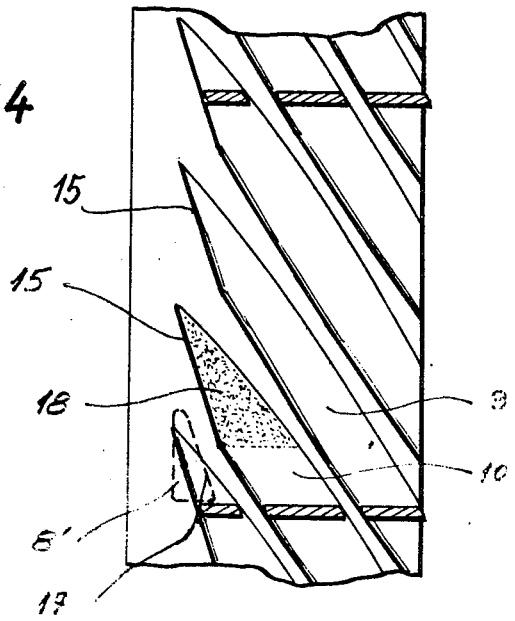
FIG. 4 is a developed view showing the worm of FIG. 3 and the position of the exhaust port.

By reason of the fact that the compression chamber has a variable depth which decreases towards the high-pressure side, the ratio of the volumes 10 to 18 is much higher than would appear to be the case from the ratio of the corresponding surfaces shown in the figure in the developed view of FIG. 4.

It is therefore possible to obtain considerable volumetric compression ratios of the order of 10 to 15 which permit delivery pressures of considerably higher value than 16 bars while retaining high-pressure ports of substantial cross-sectional area such that gas flow rates of less than 30 metres per second can be maintained under the conditions set forth in the foregoing.

The tooth flanks which are represented as being parallel can clearly be divergent or convergent or the flanks need not be strictly straight; in addition, the bevel 12 which is represented as a straight segment can have slightly curved shapes, the exact shape of the port 8' being dependent on this curvature. However, the possibility of maintaining a large cross-sectional area of the port while considerably increasing the compression ratios is obviously dependent on the difference in the lengths of the flanks 13 and 14.

It is readily apparent that an arrangement of this kind can be applied to conical or flat compressors as described in French Pat. No. 1,331,998 or to compressors in which the pinion teeth are disposed on a cone or a cylinder as described in French Pat. No. 1,586,832.

Moreover, the increase in compression ratios has been described in the case in which the compressed or expanded gas is air but clearly applies also to any gas and especially cold-producing gases.

What I claim is:

1. A compressor or rotary expansion machine comprising a globoidal worm which has a plurality of threads disposed in meshing engagement with at least one toothed pinion and which cooperates with a casing applied against at least part of the external surface of the worm, the generating line of the surface which is circumscribed about the thread crests of the worm being substantially rectilinear, at least one low-pressure port and at least one high-pressure port located in the immediate vicinity of the pinion, the flank of each tooth of said pinion which is located on the side nearest said low-pressure port when one tooth is engaged in the worm being longer than the flank of the same tooth which is located nearest said high-pressure port.

* * * * *